United States Patent [19]

Young, Jr.

[11] Patent Number: 4,757,942

[45] Date of Patent: Jul. 19, 1988

[54] DOUBLE DOOR MAILBOX

[76] Inventor: Olin E. Young, Jr., 240 Hollyberry La., Roswell, Ga. 30076

[21] Appl. No.: 43,437

[22] Filed: Apr. 28, 1987

[51] Int. Cl.[4] ..... B65D 91/00

[52] U.S. Cl. ..... 232/17; 232/43.4

[58] Field of Search ..... 232/17, 19, 20, 27, 232/38, 41 B, 43.4

[56] References Cited

U.S. PATENT DOCUMENTS 3,054,555 9/1962 Saxon ..... 232/43.4
3,106,335 10/1963 Allan ..... 232/17
4,220,278 9/1980 Hasselbring ..... 232/17 X
4,447,005 5/1984 Kelly et al. ..... 232/43.4

*Primary Examiner*—Robert W. Gibson, Jr.
*Attorney, Agent, or Firm*—Hurt, Richardson, Garner, Todd & Cadenhead

[57] ABSTRACT

A double door rural type mailbox having a door actuating mechanism which extends between and is connected to the two doors to insure that only one door is open at any one time. The door mechanism also permits the opening and closing of each door independent of the opposite door when the opposite door is in its closed position.

2 Claims, 2 Drawing Sheets

DOUBLE DOOR MAILBOX

BACKGROUND OF THE INVENTION

1. Field of the Invention

This invention relates to a double door mailbox, in particular to a mailbox having a door actuating mechanism for coordinating the opening and closing of the two doors.

2. Description of the Prior Art

As traffic in many areas continues to increase, it is becoming considerably more dangerous to remove the mail from a rural type mailbox situated on a frequently traveled roadway. Numerous accidents have been reported where a person attempting to remove the mail from the box has been seriously injured or killed while doing so.

Other two door mailboxes have been disclosed in the prior art, however, they have generally been constructed having conventional type doors which require manual opening and closing of each door. The Postmaster General disapproves of this type of construction because the postman frequently finds that the rear door has been left open and, therefore, the mail is likely to slide out the back.

Attempts have been made to construct a two door mailbox having the doors spring biased in a closed position. The spring biasing, however, makes it difficult for the postman to deliver the mail because two hands are required for placing the mail inside the mailbox, one hand for inserting the mail and one hand to hold the door open to avoid the spring mounted door from slamming shut on the other hand. Additionally, spring mounted doors are particularly dangerous for young children as they attempt to remove the mail. Mailboxes having spring biased doors have never been approved by the Postmaster General.

SUMMARY OF THE INVENTION

Accordingly, it is an object of the present invention to provide a double door mailbox which makes it unnecessary for the person removing the mail to step into the path of oncoming traffic.

Another object of this invention is to provide a double door mailbox with a door actuating mechanism that prevents both doors from being open at the same time.

Another object of this invention is to provide a double door mailbox with a door actuating mechanism to permit each door to be opened and closed independently from the opposite door, when the opposite door is in its closed position.

Another object of the present invention is to provide a door actuating mechanism for use with doors having standard friction-type closing mechanisms which eliminates the need for spring biasing elements.

Briefly, to overcome the disadvantages in the prior art and meet the above objectives, the double door rural mailbox of the present invention comprises a mailbox main body having two open ends and two substantially identical doors, one door pivotally mounted at each end of the mailbox for movement between a closed position and an open position. The mailbox also has a door actuating means operatively associated with and extending between the two doors for coordinating the opening and closing of the doors to insure that as one door moves from its open position to its closed position, the opposite door, when in its closed position, remains closed, or as one door moves from its closed position to its open position, the opposite door when in its open position, moves to its closed position.

The door actuating means comprises an elongate control sleeve which is mounted to the body of the mailbox for reciprocal movement between the two doors. The control sleeve has enclosed opposite ends, each end having an aperture formed therein. Each door has an actuating rod pivotally attached thereto and slidably received within the proximal control sleeve aperture. The opposite end of the actuating rod extends into the interior of the control sleeve. A stop means is attached to the end of the actuating rod which is located inside the sleeve. The length of each actuating rod is such that as the stop means of the rod attached to the door moving from its closed position to its open position comes into contact with the closed end of the control sleeve, the stop means slides the control sleeve in the same direction as the opening door until the door is in its open position. Simultaneously, the opposite end of the control sleeve moves into contact with the stop means of the actuating rod attached to the opposite door which is in its closed position. Should the open door be inadvertently left open, the opening of the opposite closed door will result in the closing of the open door.

In a preferred embodiment of the present invention, two door actuating means are secured to the inside of the mailbox, one on each of the sidewalls. The control sleeve has a generally C-shaped configuration, the top portion of the C extends downwardly and is slideably received in a channel which is formed by a guide roller and guide bar, the guide bar being secured to the side wall of the mailbox. The control sleeve is enclosed in a protective covering.

The apertures through which the actuating rods pass are preferably elliptical in configuration to permit the actuating rods to angle downwardly as the mailbox doors are moved to their respective open positions. The elliptical configuration of the aperture also facilitates the insertion of the rods into the control sleeve and cooperates with the stop means to keep the rod from sliding out of the control sleeve when a door is opened.

DETAILED DESCRIPTION OF THE DRAWINGS

Figure 1:
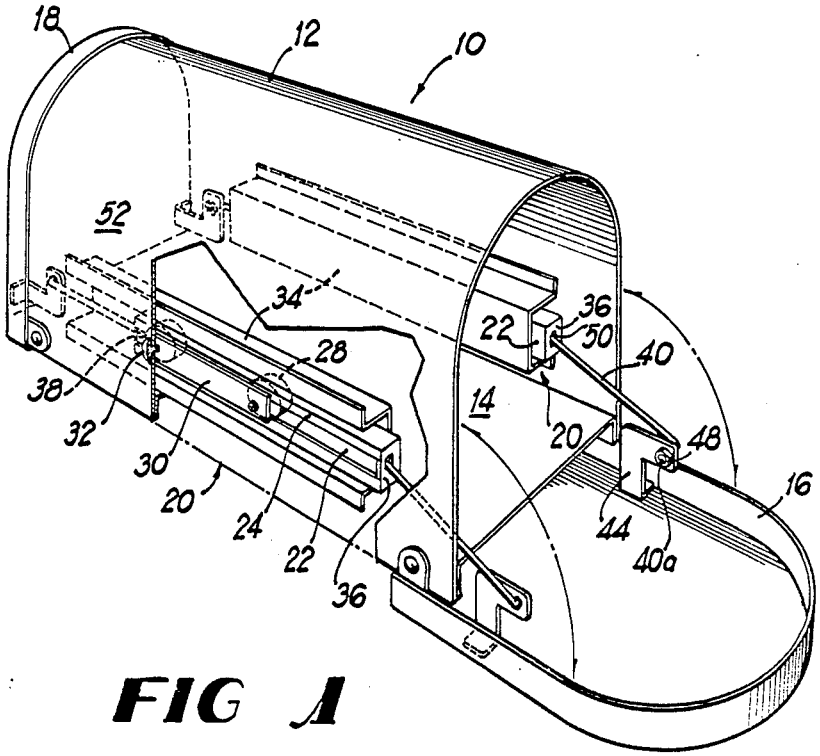
FIG. 1 is a perspective view of the invention.

Referring now in detail to the embodiment chosen for the purpose of illustrating the present invention, numeral 10 in FIG. 1–FIG. 4 denotes generally the main body of the double door mailbox. Main body 10 is constructed according to the guidelines established by the Postmaster General and is formed having a curved roof section 12, a flat floor 14, and two open ends. Any rust-free conventional material, such as aluminum or galvinized iron, may be used for construction of the mailbox.

The mailbox has two substantially identical doors, one door 16 is hingedly mounted on the carrier or delivery side of the mailbox. Opposite door 18 is mounted on the mail removal side which is used by the mailbox owner.

As discussed above, a major problem with two door mailboxes is that the mail carrier often finds the mailbox with the owner side door 18 in the open position, thus making it difficult for the mail carrier to assure that the mail is placed properly within the box. The present invention solves this problem by providing a double door mailbox where only one door can be open at any one time. This is accomplished by constructing a door actuating mechanism 20 which is operatively associated with and extends between doors 16 and 18.

Figure 3:
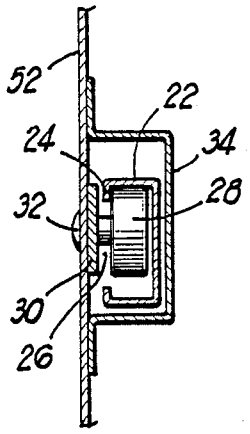
FIG. 3 is a cross-sectional view taken along lines 3—3 in FIG. 2.

As shown in FIG. 1 and FIG. 3, actuating mechanism 20 comprises an elongate control sleeve 22 having a generally C-shaped configuration wherein the downwardly extending projection 24 is slidably situated within channel 26 formed by guide roller 28 and guide bar 30. Guide roller 28 can be a conventional fiber roller having a diameter of approximately $\frac{3}{4}''$ and a thickness of about $\frac{3}{8}''$. Guide bar 30 is preferably made of a low friction type material such as nylon or polyvinyl chloride. Rivet 32 extends through an aperture (not shown) formed in the side of the mailbox to secure guide roller 28 and guide bar 30 in place. As shown in the preferred embodiment, two guide rollers 28 are used to maintain proper alignment of control sleeve 22 as it moves between doors 16 and 18.

The ends of control sleeve 22 are enclosed by placing end plates 36 and 38 at each end. Protective housing 34 is placed over control sleeve 22 to prevent any extraneous debris from blocking channel 26. Protective housing 34 is secured to the side of the mailbox by any conventional means.

Actuating rods 40 and 42 are pivotally attached to doors 16 and 18, respectively via brackets 44. Rods 40 and 42 are of the reverse hook type construction where hook end **40*a* is pivotally attached to door 16 via bracket 44 by inserting hook 40*a* through hole 46 and securing thereto with hex cap nut 48**.

Actuating rod 40 extends into the interior of control sleeve 22 by passing through aperture 50 formed in end plate 36. Reverse hook **40*b* functions as a convenient stop means to keep actuating rod 40 from sliding out of control sleeve 22 through aperture 50. To facilitate easy insertion and removal of actuating rod 40 into control sleeve 22, aperture 50 is preferably elliptical in shape having dimensions that are just slightly larger than those of reverse hook 40*b*. For insertion, hook 40*b* is aligned with the longer axis of aperture 50, inserted into control sleeve 22 and then rotated 90°. This orientation maintains the reverse hook end 40*b* of rod 40 within control sleeve 22 when door 16** is moved from its closed position to its open position.

Actuating rod 42 is identical to actuating rod 40 and is secured to door 18 and control sleeve 22 in the same manner as that discussed above for actuating rod 40.

Figure 2:
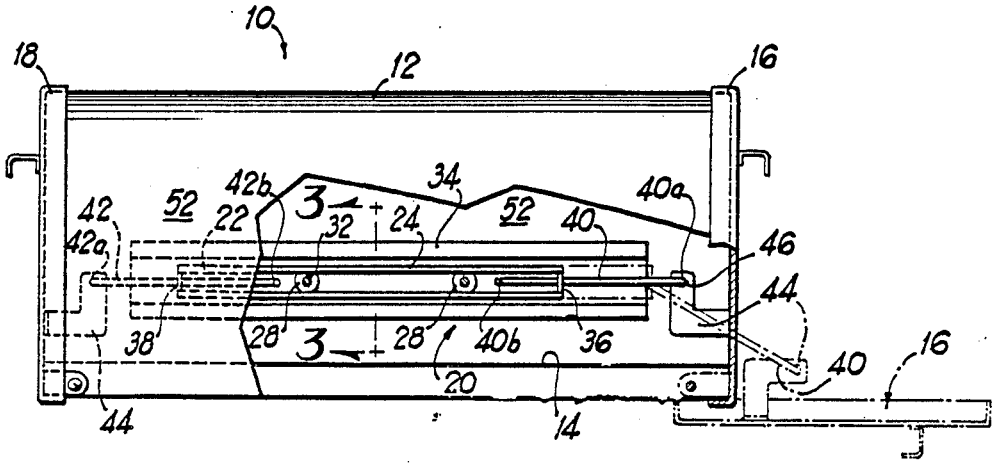
FIG. 2 is a side elevational view with portions cut away to show internal workings.

In actual operation, it can be seen that when both doors 16 and 18 are in their closed positions, the opening and closing of each door is independent of the opposite door. For example, as illustrated in FIG. 2, doors 16 and 18 are in their closed position. As delivery door 16 is moved to its open position, as shown in phantom in FIG. 2, actuating rod 40 is pulled through aperture 50 thus coming into contact with end plate 36 when door 16 is located halfway between its closed and open position. As door 16 is opened completely, reverse hook **40*b* urges control sleeve 22 towards the opening door 16 until end plate 38 located on the opposite end of sleeve 22 comes into contact with reverse hook 42*b* located on actuating rod 42. The length of control sleeve 22 and actuating rods 40 and 42 have been determined so that the distance traveled by control sleeve 22 is that distance which permits the opening of one mailbox door at a time. For example, for a conventional mailbox having a length of 23", control sleeve 22 should be $17\frac{1}{2}''$ and positioned midway between doors 16 and 18 leaving a distance of $2\frac{3}{4}''$ between the ends of control sleeve 22 and each door. Actuating rods 40 and 42 are $6\frac{1}{2}''$ long with $\frac{1}{4}''$ reverse hooks at each end. Brackets 44 are mounted to doors 16 and 18, respectively, and actuating rod ends 40*a* and 42*a*** are secured thereto, $\frac{3}{4}''$ from each door. The above dimensions are for illustrative purposes only and are not intended to limit the invention in any manner.

Figure 4:
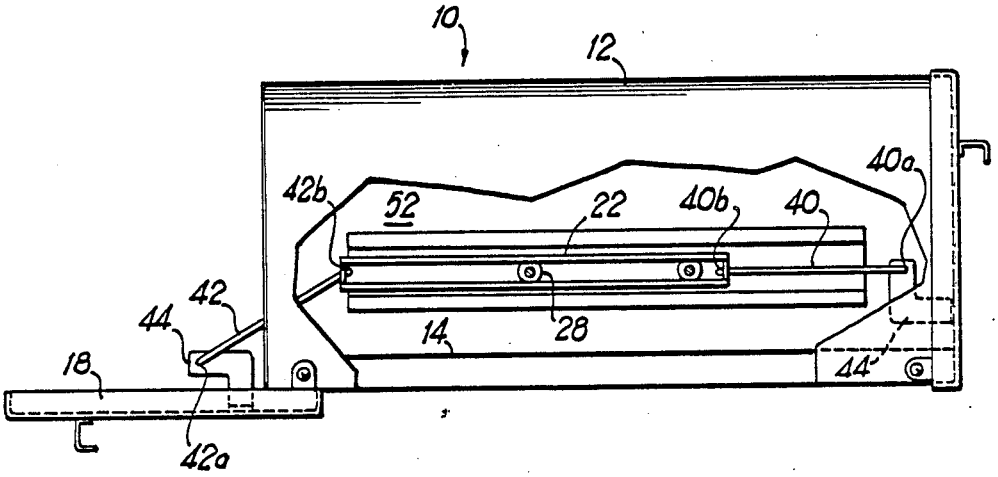
FIG. 4 is a side elevational view with portions cut away to show internal workings.

As illustrated in phantom in FIG. 2, control sleeve 22 has traveled its maximum distance in one direction towards open door 16. The reverse hook **42*b* of actuating rod 42 is in contact with end plate 38 of control sleeve 22. When door 18 is moved to its open position as shown in FIG. 4, door 16 is pulled to its closed position by the concerted action of actuating rod 42 on control sleeve 22 and ultimately on actuating rod 40**.

Preferably, one door actuating means 20 should be mounted on each interior sidewall 52 as shown in FIG. 1. This particular embodiment results in an equal amount of force being exerted on each side of the door, thus preventing any possible distorting or warping which may occur if only one actuating mechanism is used.

It will be obvious to those skilled in the art that many variations may be made in the embodiment and dimensions chosen for the purpose of illustrating the present invention, without departing from the scope thereof, as defined by the appended claims.

What is claimed is:

1. A double door rural mailbox comprising:

a mailbox main body having two open ends;

two substantially identical doors, one door hingedly mounted at each end of the mailbox for movement between a closed position and an open position;

a door actuating means operatively associated with and extending between the two doors for coordinating the opening and closing of the doors to insure that as one door moves from its open position to its closed position, the opposite door, when in its closed position, remains closed, or as one door moves from its closed position to its open position, the opposite door, when in its open position, moves to its closed position, wherein the door actuating means comprises a pair of guide rollers attached to the side of the main body of the mailbox, an elongated control sleeve slidably engaging the guide rollers for reciprocal movement between the two doors, the control sleeve having enclosed opposite ends, each end having an aperture formed therein, wherein the guide rollers are positioned inside the control sleeve to facilitate the reciprocal movement of the control sleeve between the two doors, a pair of actuating rods, each being pivotally attached at one end to one of the mailbox doors and slideably received within the proximal control aperture, the oppsoite end of each rod extending into the interior of the control sleeve; and a stop means attached to the end of the actuating rod inside the sleeve, wherein the length of each actuating rod is that which permits the stop means of the rod attached to the door moving from its closed position to its open position to come into contact with the closed end of the control sleeve and thereby to slide the control sleeve in the same direction as the opening door until the door is in its open position and the oppsoite end of the control sleeve has been moved into contact with the stop means of the actuating rod attached to the opposite door which is in its closed position.

2. The invention of claim 1 further comprising a protective housing for enclosing the door actuating means.

* * * * *